US009932818B2

(12) United States Patent
Hay et al.

(10) Patent No.: US 9,932,818 B2
(45) Date of Patent: Apr. 3, 2018

(54) APPARATUS AND METHOD FOR DRILLING A WELL

(75) Inventors: Richard T Hay, Spring, TX (US); Malcolm R Upshall, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 885 days.

(21) Appl. No.: 13/988,017

(22) PCT Filed: Nov. 17, 2010

(86) PCT No.: PCT/US2010/056957
§ 371 (c)(1),
(2), (4) Date: Aug. 14, 2013

(87) PCT Pub. No.: WO2012/067611
PCT Pub. Date: May 24, 2012

(65) Prior Publication Data

US 2013/0341092 A1 Dec. 26, 2013

(51) Int. Cl.
*E21B 7/04* (2006.01)
*E21B 47/022* (2012.01)

(52) U.S. Cl.
CPC ..... *E21B 47/022* (2013.01); *E21B 7/04* (2013.01); *E21B 47/02216* (2013.01)

(58) Field of Classification Search
CPC ... E21B 7/04; E21B 7/06; E21B 7/022; E21B 7/02216; E21B 44/005
See application file for complete search history.

(56) References Cited

U.S. PATENT DOCUMENTS

| | | | |
|---|---|---|---|
| 4,458,767 | A | 7/1984 | Hoehn, Jr. |
| 5,074,365 | A | 12/1991 | Kuckes |
| 5,305,212 | A | 4/1994 | Kuckes |
| 5,343,152 | A | 8/1994 | Kuckes |
| 5,515,931 | A | 5/1996 | Kuckes |
| 5,589,775 | A | 12/1996 | Kuckes |

(Continued)

FOREIGN PATENT DOCUMENTS

| | | |
|---|---|---|
| WO | 2009151444 | 12/2009 |
| WO | 2009151867 A2 | 12/2009 |

(Continued)

OTHER PUBLICATIONS

Australian Patent Examination Report dated Nov. 16, 2015; Australian Patent Application No. 2010363968.

*Primary Examiner* — Kenneth L Thompson
*Assistant Examiner* — Steven A MacDonald
(74) *Attorney, Agent, or Firm* — McGuire Woods LLP

(57) ABSTRACT

A system for drilling at least one well of interest proximate a reference well comprises at least one sensor in a drill string in the at least one well of interest to detect at least one parameter of interest related to a distance and a direction to the reference well. A controller is operatively coupled to the at least one sensor to determine the distance and the direction from the sensor to the reference well based at least in part on the at least one detected parameter of interest. A steerable assembly is operatively coupled to the controller to receive commands from the controller to adjust the path of the at least one well of interest being drilled based at least in part on the distance and direction from the sensor to the reference well.

6 Claims, 18 Drawing Sheets

(56) References Cited

U.S. PATENT DOCUMENTS

| | | | | |
|---|---|---|---|---|
| 5,657,826 | A | 8/1997 | Kuckes | |
| 5,676,212 | A | 10/1997 | Kuckes | |
| 5,923,170 | A | 7/1999 | Kuckes | |
| RE36,569 | E | 2/2000 | Kuckes | |
| 6,084,826 | A * | 7/2000 | Leggett, III | E21B 44/00 181/102 |
| 6,109,370 | A * | 8/2000 | Gray | E21B 7/065 175/215 |
| 6,206,108 | B1 * | 3/2001 | MacDonald | E21B 44/00 175/24 |
| 6,513,606 | B1 * | 2/2003 | Krueger | E21B 44/005 166/255.1 |
| 6,516,898 | B1 * | 2/2003 | Krueger | E21B 4/18 175/230 |
| 6,530,154 | B2 | 3/2003 | Towle | |
| 6,732,052 | B2 * | 5/2004 | Macdonald | E21B 44/005 175/24 |
| 7,475,741 | B2 | 1/2009 | Waters | |
| 7,568,532 | B2 | 8/2009 | Kuckes | |
| 2007/0278008 | A1 | 12/2007 | Kuckes | |
| 2009/0194333 | A1 * | 8/2009 | MacDonald | E21B 43/24 175/45 |
| 2015/0096805 | A1 * | 4/2015 | Kruspe | E21B 44/005 175/45 |
| 2015/0167393 | A1 * | 6/2015 | Rasheed | E21B 44/005 175/24 |

FOREIGN PATENT DOCUMENTS

| | | | |
|---|---|---|---|
| WO | 2010141004 | A1 | 12/2010 |
| WO | 2011002461 | A1 | 1/2011 |

* cited by examiner

APPARATUS AND METHOD FOR DRILLING A WELL

BACKGROUND OF THE INVENTION

The present disclosure relates generally to the field of drilling wells and more particularly to drilling at least one well along a path referenced to at least one other well.

The difficulties encountered in guiding the drilling of a borehole to follow a desired path at distances of thousands of feet below the surface of the earth are well known. In some applications it is beneficial, from a production standpoint, to drill multiple, closely-spaced wells. These wells may contain horizontal portions.

In other examples, it may be desirable to drill multiple wells originating from a platform and extending along various paths to different parts of a reservoir. The paths of the wells may need to be controlled to reach their desired targets and/or to avoid collision with other wells during the drilling process.

In yet another example, drilling requirements in low permeability and/or heavy viscous fluids may require closely spaced wells. For example, in steam assisted gravity drainage wells, steam may be injected in one horizontal well to mobilize heavy, viscous liquids in the surrounding formation that may be recovered in closely spaced nearby wells.

BRIEF DESCRIPTION OF THE DRAWINGS

A better understanding of the present invention can be obtained when the following detailed description of example embodiments are considered in conjunction with the following drawings, wherein like elements have like numbers, in which.

DETAILED DESCRIPTION

Described below are several illustrative embodiments of the present invention. They are meant as examples and not as limitations on the claims that follow.

Figure 1:
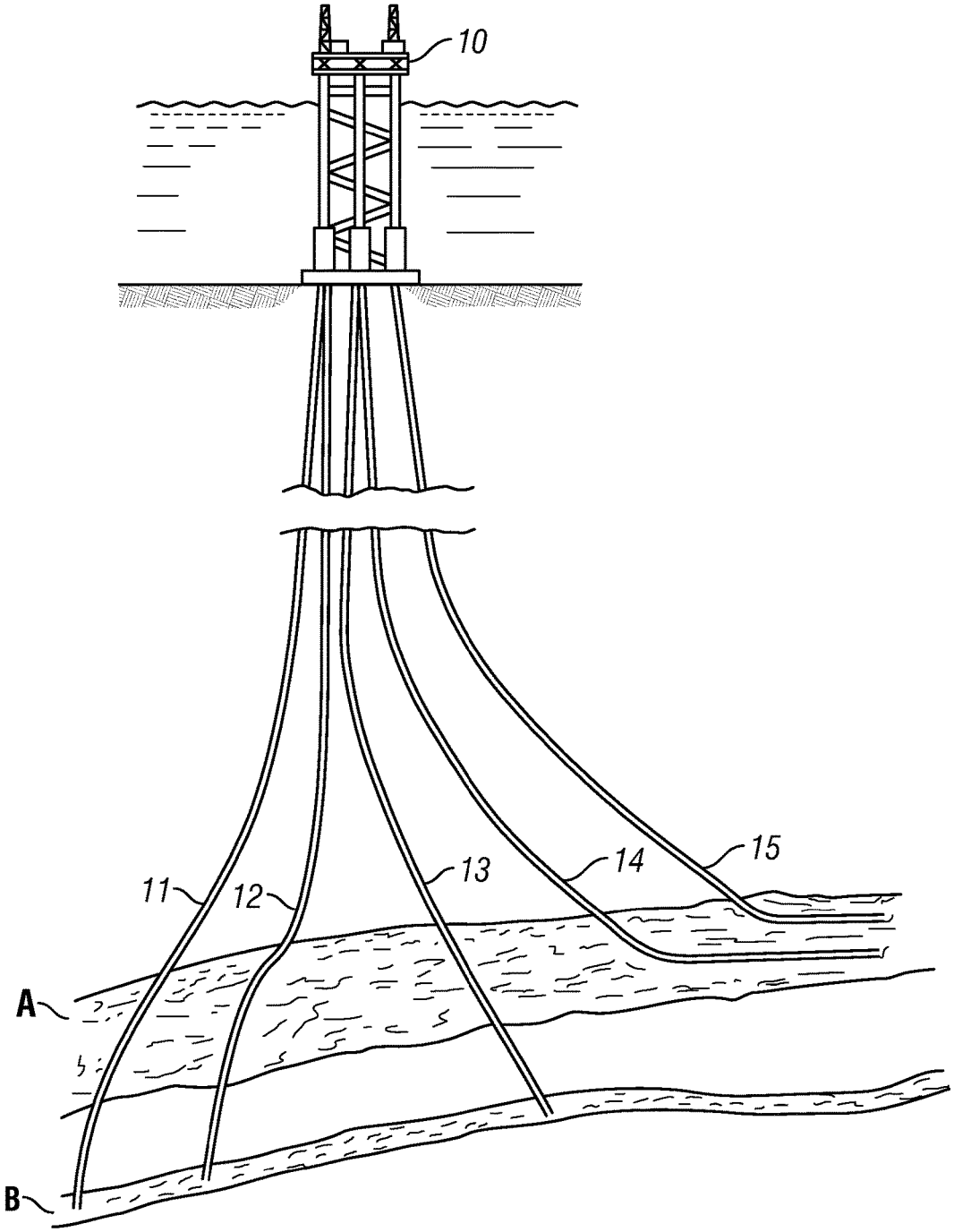
FIG. 1 shows an example of a drilling platform.

FIG. 1 shows an example of a drilling platform 10. Multiple wells may be drilled from platform 10 into target formations A and B. One skilled in the art will appreciate that the spacing between the well heads on platform 10 may be on the order of 3-5 m. Such close initial spacing may require wells to be closely monitored and steered to prevent intrusion of one well into another. As shown, wells 11, 12, and 13 may be drilled along predetermined paths to intersect desired target locations in formations A and B. The number of such wells drilled off of such a platform depends on many factors. It will be appreciated that the well paths shown may be 3 dimensional wells deviating into and/or out of the plane shown of FIG. 1. In another example, wells 14 and 15 may be drilled to maintain a relatively close proximity to each other in formation A.

Common survey methods make directional measurements of inclination and azimuth at multiple locations along the path of the well from the surface. Using the directional measurements and a measured distance between each measurement location, a well path may be calculated. Such a technique tends to propagate the uncertainty errors associated with each measurement. Such uncertainties may be on the order of 3-5 m/300 m of measured drilled depth. In addition, the calculated distance between two well locations downhole involves the subtraction of two uncertain locations, calculated as described. The uncertainty of such a calculated difference in downhole well position between two wells of interest may be substantially greater than the allowable spacing between such wells.

In one example, in steam assisted gravity drainage (SAGD) wells, it may be desirable to locate the drainage well at a substantially constant distance from the steam well. Example distances may be within 3-5 m±0.2 m of the steam well. In collision avoidance, similar separation distances and accuracies may be encountered. In instances where accurate well location and/or separation distance is required, different well location techniques are required.

In order to reduce the uncertainty in well positions relative to each other, the wells shown in FIG. 1 may use a relative measurement between a drilling well and a reference well. For example, well 12 may be drilled initially and used as a reference well for wells 11 and 13. Techniques described below may be used to measure the distance and direction of wells 11 and 13 from reference well 12 and to drill the new wells along predetermined paths relative to the path of well 12. It is intended that any well may become a reference well for purposes of this disclosure. For example, well 11 may be initially drilled and used as a reference well for well 12. Once well 12 is drilled, it may serve as a reference well for well 13. In a similar manner, well 14 may be drilled and then used as a reference well for well 15, or vice versa. By using the relative measurement of one well referenced to a reference well at a location, the uncertainty of the distance between the two wells may be reduced to the uncertainty of each relative distance measurement. The uncertainty in the relative distance measurement may be orders of magnitude smaller than the uncertainty of position measurements using traditional survey techniques.

Figure 2:
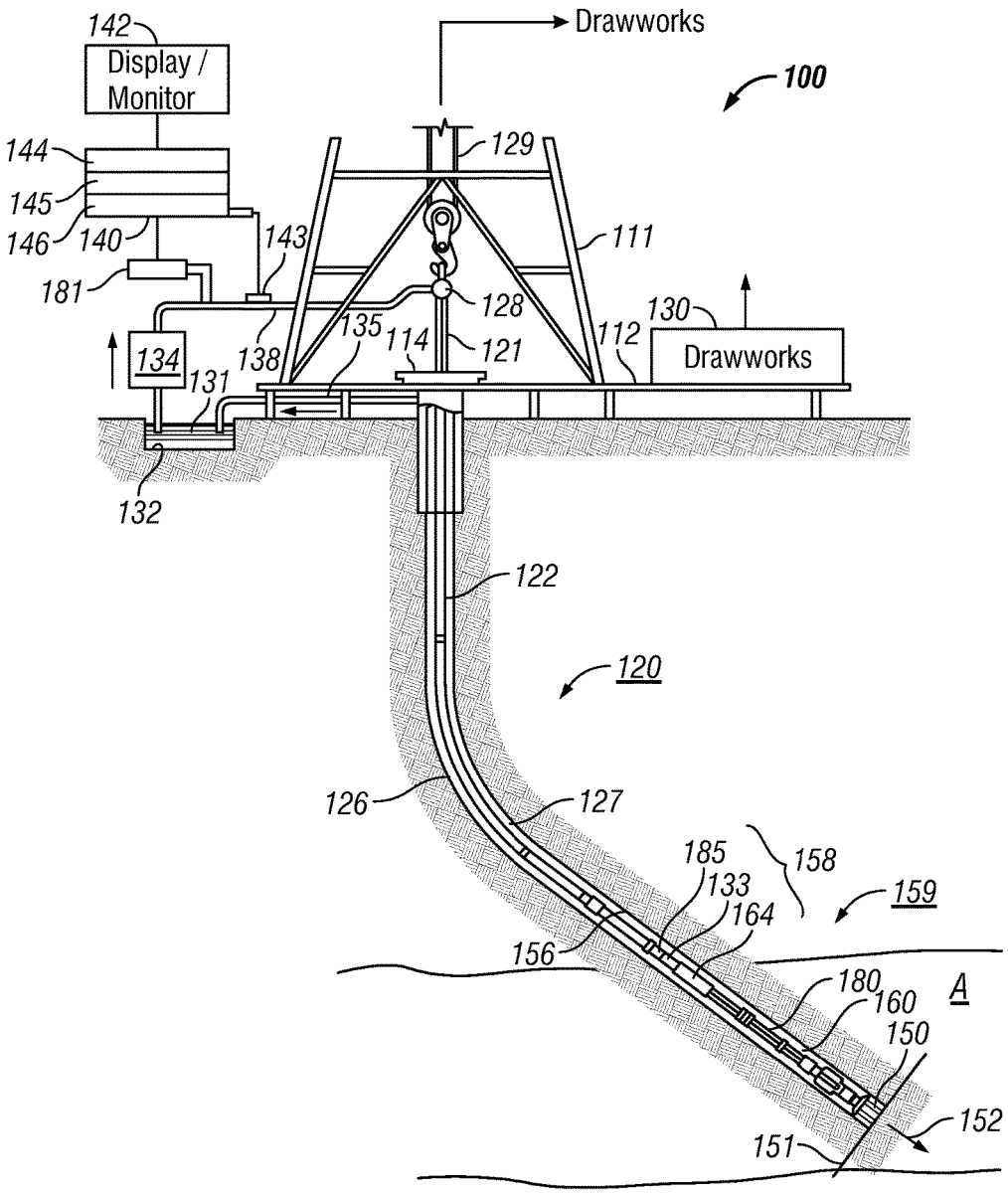
FIG. 2 shows a schematic diagram of one example of a drilling system.

FIG. 2 shows a schematic diagram of one example of a drilling system 100. As shown, drilling system 100 comprises a conventional derrick 111 erected on a rig floor 112 which supports a rotary table 114 that is rotated by a prime mover (not shown) at a desired rotational speed. A drill string 120 that includes a drill pipe section 122 extends downward from rotary table 114 into a directional borehole 126. Borehole 126 may travel in a three-dimensional path. The three-dimensional direction of the bottom 151 of borehole 126 is indicated by a pointing vector 152. A drill bit 150 is attached to the downhole end of drill string 120 and disintegrates the geological formation A when drill bit 150 is rotated. The drill string 120 is coupled to a drawworks 130 via a kelly joint 121, swivel 128 and line 129 through a system of pulleys (not shown). During the drilling operations, drawworks 130 is operated to control the weight on bit 150 and the rate of penetration of drill string 120 into borehole 126. The operation of drawworks 130 is well known in the art and is thus not described in detail herein.

During drilling operations a suitable drilling fluid (commonly referred to in the art as "mud") 131 from a mud pit 132 is circulated under pressure through drill string 120 by a mud pump 134. Drilling fluid 131 passes from mud pump 134 into drill string 120 via fluid line 138 and kelly joint 121. Drilling fluid 131 is discharged at the borehole bottom 151 through an opening in drill bit 150. Drilling fluid 131 circulates uphole through the annular space 127 between drill string 120 and borehole 126 and is discharged into mud pit 132 via a return line 135. A variety of sensors (not shown) are appropriately deployed on the surface according to known methods in the art to provide information about various operational parameters, for example fluid flow rate, weight on bit, hook load, etc.

In one example, a surface control unit 140 may receive signals transmitted from downhole. For example, using mud pulse telemetry, a pressure sensor 143 placed in fluid line 138 detects pressure signals that may be processed according to programmed instructions provided to surface control unit 140. Surface control unit 140 may display desired drilling parameters and other information on a display/monitor 142 which may be used by an operator to control the drilling operations. Surface control unit 140 may contain a processor 144 in data communication with a memory 145, and a data storage module 146 for storing data. Surface control unit 140 may also comprise drilling models stored in memory 145 and may process data according to programmed instructions, and respond to user commands entered through a suitable input device, such as a keyboard (not shown).

In one example embodiment of the present invention, a steerable drilling bottom hole assembly (BHA) 159 may comprise a measurement while drilling (MWD) system 158 comprising a downhole controller 185, a telemetry transmitter 133, and a sensor section 164 to provide information about formation and downhole drilling parameters. BHA 159 may be coupled between the drill bit 150 and the drill pipe 122. In one example, BHA 159 may also comprise a drilling motor 180 and a steerable drilling assembly 160 suitable for controllably changing the direction of wellbore 126. Such steering drilling assemblies are commercially available, for example the Geo-Pilot® brand of steerable drilling assembly available from Halliburton, Inc., Houston, Tex. Alternatively, any other suitable steerable drilling assembly may be used.

Figure 3:
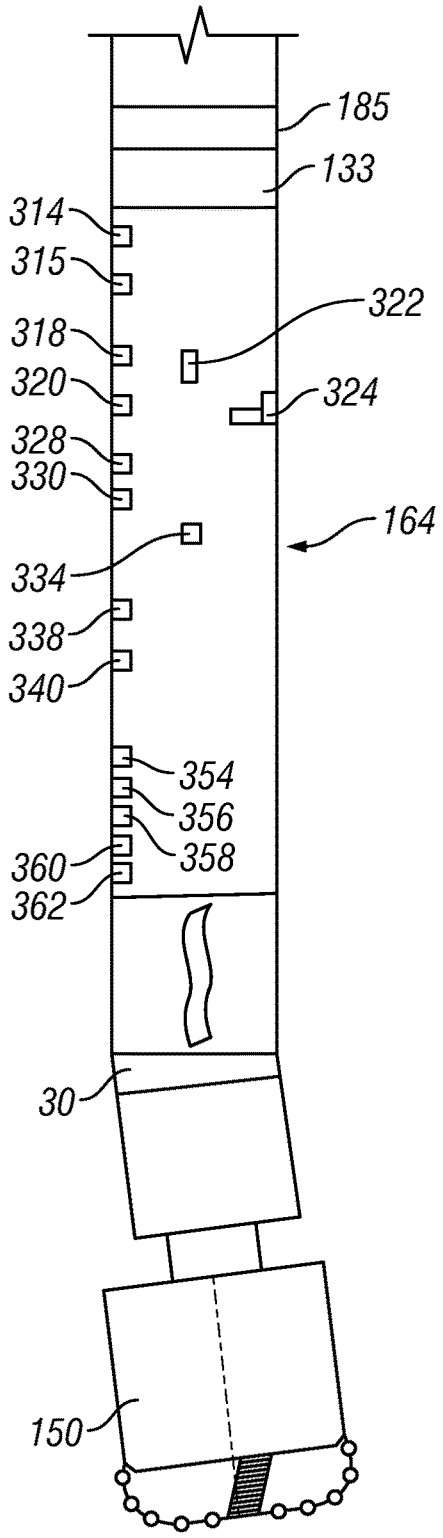
FIG. 3 shows an example of a sensor section.

Referring also to FIG. 3, sensor section 164 may comprise one or more directional sensors 314, 315 which are conventionally used in an MWD system; one or more pressure-while-drilling sensors 318, 320; one or more sensors 322 may for sensing the fluid pressure in the interior of the BHA, and another sensor 324 for sensing the pressure in the annulus surrounding the BHA. Sensor section 164 may also comprise one or more weight-on-bit (WOB) sensors 328 and/or one or more torque-on-but (TOB) sensors 330; one or more tri-axial vibration sensors 334; one or more caliper sensors 338; one or more hole image sensors 340; one or more gamma sensors 354; one or more resistivity sensors 356; one or more neutron sensors 358; one or more density sensors 360; and one or more sonic sensors 362. These sensors are typical of the type of sensors used in such applications and should be considered exemplary and not limiting. The sensors described may be contained in a single sub or in several separate subs using techniques known in the art. The above-noted sensors may transmit sensor data over a suitable downhole communication bus to downhole controller 185, which may process and transmit data related to the downhole measurements via telemetry transmitter 133 to surface control unit 140.

Figure 4:
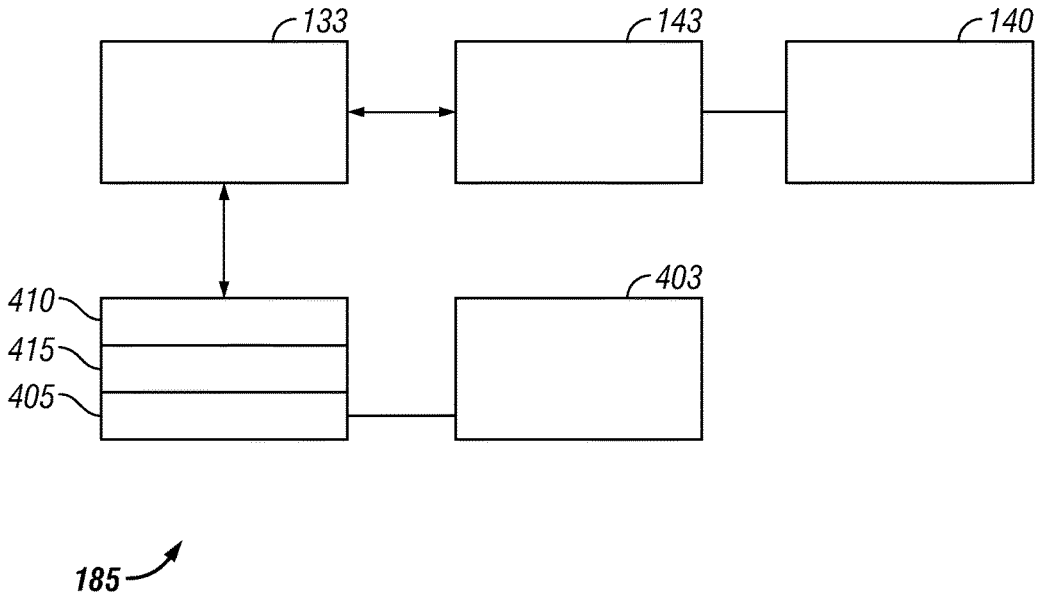
FIG. 4 shows a functional block diagram of one example downhole controller.

Downhole controller 185 may comprise, also see FIG. 4, suitable electronic sensor interfaces 405. Sensor interface 405 receives signals from sensors 403, which may be any of the sensors described above in FIG. 3, and communicates with downhole processor 410 which is in data communication with memory 415. In one embodiment, separate downhole processors may be associated with each sensor type and contain suitable conversion and scaling parameters associated with the particular measurement. In one example, memory 415 may contain suitable instructions for calculating actual and desired well paths, well path data for the reference well, and instructions for autonomously controlling steerable drilling assembly 160 along the desired well path.

In one embodiment a mud pulse telemetry technique may be used to communicate data from downhole sensors and devices during drilling operations. As indicated above, transducer 143 placed in the mud supply line 138 detects the mud pulses responsive to the data transmitted by the downhole transmitter 133. Transducer 143 generates electrical signals in response to the mud pressure variations and transmits such signals to surface control unit 140. Alternatively, other telemetry techniques such as electromagnetic and/or acoustic telemetry techniques or any other suitable technique known in the art may be utilized for the purposes of this invention. In one embodiment, hard wired drill pipe may be used to communicate between the surface and downhole devices. In one example, combinations of the techniques described may be used.

In one embodiment, a surface transmitter/receiver 181 (FIG. 2) may communicate with downhole tools using any of the transmission techniques described, for example a mud pulse telemetry technique. This may enable two-way communication between surface control unit 140 and the downhole tools described herein.

Figure 5:
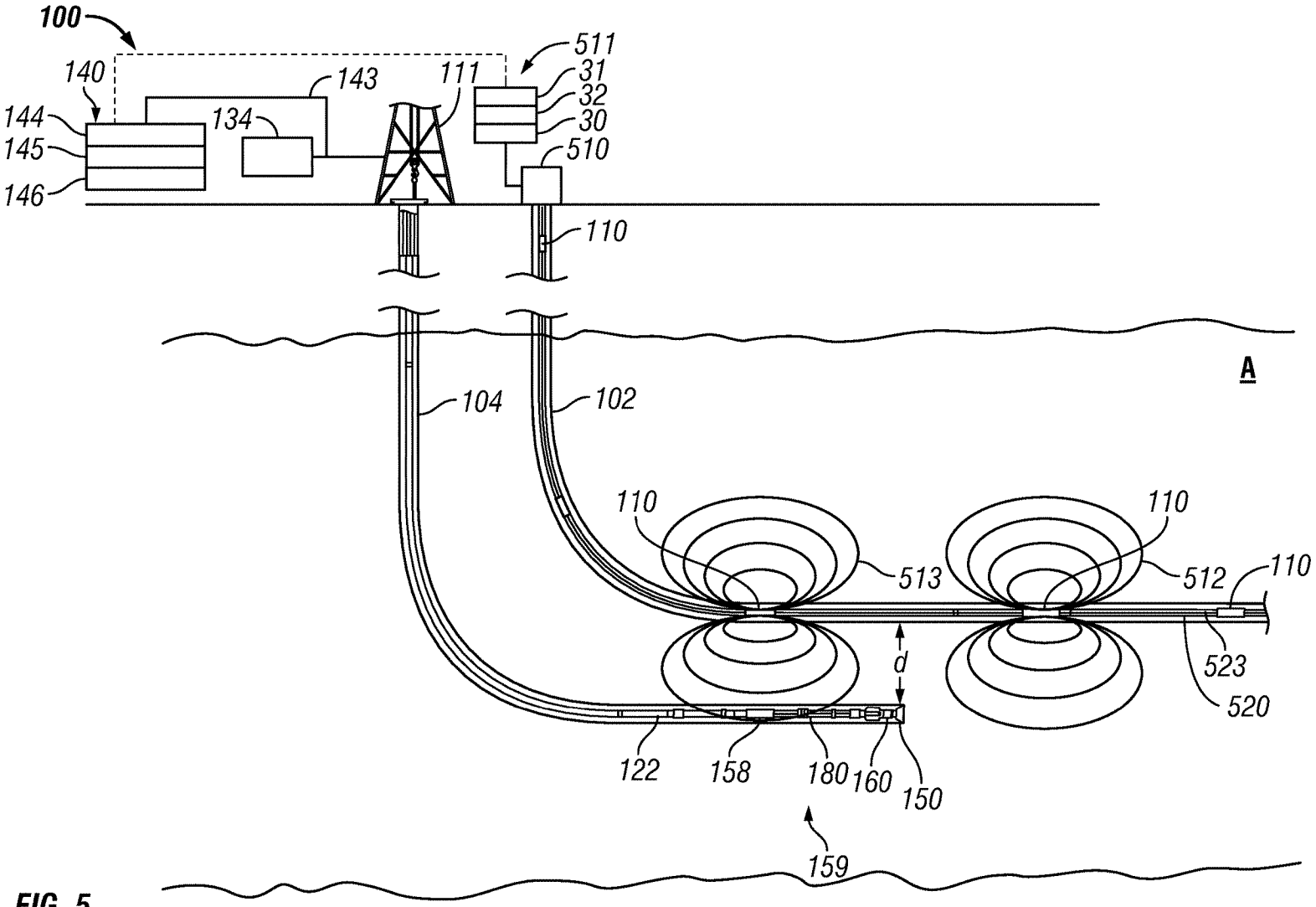
FIG. 5 shows one schematic example of a drilling system for drilling at least one well with relation to a reference well.

FIG. 5 shows one schematic example of a drilling system for drilling at least one well with relation to a reference well. In this example, reference well 102 extends from a surface location and is turned to have a substantially horizontal section penetrating formation A. Alternatively, well 102 may be substantially vertical, inclined from vertical, and a combination of any of the above paths. Well 104 is being drilled according to a predetermined plan in formation A in close proximity to reference well 102. Distance d indicates the true separation in 3-dimensional space between drilling well 104 and reference well 102. While shown in FIG. 5 as substantially parallel wells, it should be noted that drilling well 104 may be planned to drill along a path that diverges and/or converges with the path of reference well 102 such that distance d increases and/or decreases along the path of well 104.

In the embodiment shown in FIG. 5, a tubing string 520 has a plurality of spaced apart transmitters 110 and is deployed in reference well 102. Transmitters 110 may be configured to transmit at least one of: a magnetic signal; an electrical signal; and an acoustic signal.

In one embodiment, each transmitter 110 may comprise a magnetic coil for transmitting a magnetic signal in the surrounding formation. In the example shown, tubing string 520 may be a coiled tubing, a jointed pipe, or a combination of coiled tubing and jointed pipe. In one example, tubing string 520 may be a composite tubing. Alternatively, the plurality of spaced apart transmitters 110 may be deployed in reference well 102 on a wireline. In one embodiment the plurality of spaced apart transmitters may be connected by a relatively small diameter tubing and installed in a larger diameter coiled tubing for deployment and retrieval.

Figure 6:
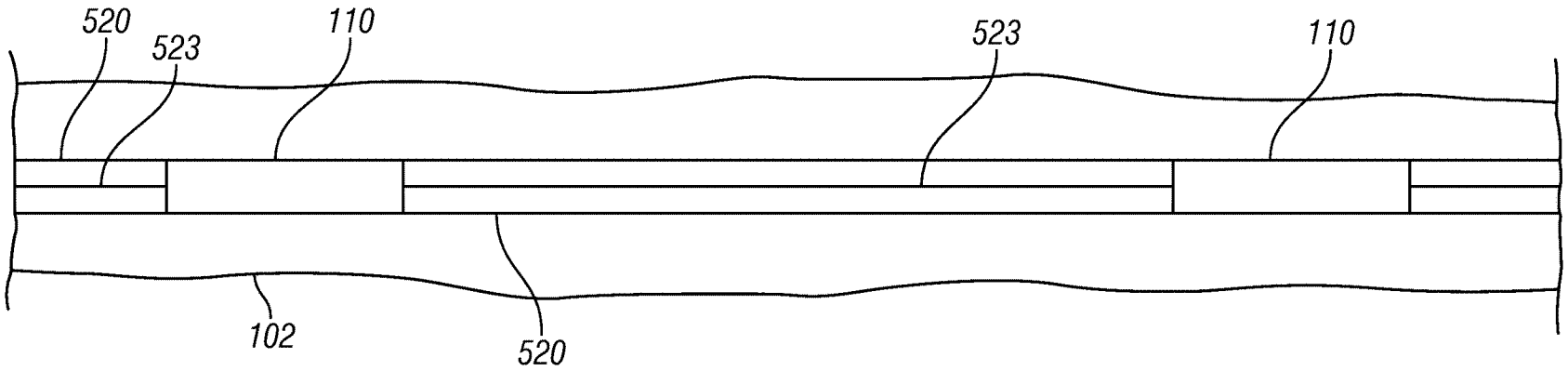
FIG. 6 shows an example of a conductor connecting each transmitter to each previous transmitter.
Figure 7:
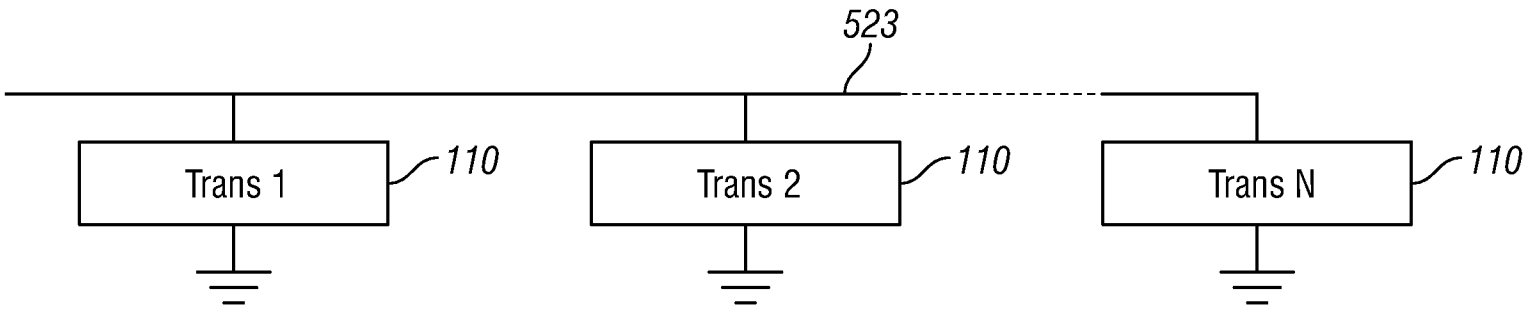
FIG. 7 shows one example of a bus structure utilizing an electrical conductor connecting N transmitters.

Referring to FIG. 5 and FIG. 6, a conductor 523 runs inside of tubing string 520 to connect each transmitter 110 to the previous transmitter 110. Conductor 523 may comprise electrical and/or optical conductors. Conductor 523 connects the transmitters 110 to surface controller 511 through wellhead 510. Alternatively, conductor 523 may run down the outside of tubing 520 and tap into each transmitter 110. In yet another alternative embodiment, tubing string 520 may be a composite tubing having at least one conductor embedded in the wall of the tubing. FIG. 7 shows one example of a bus structure utilizing electrical conductor 523, and connecting N transmitters 110. Power and/or communications may be transmitted along conductor 523. In one embodiment, each transmitter may have a unique address on the bus.

When energized, transmitters 110 may produce magnetic fields 513 and 512, FIG. 5. Magnetic fields 513 and 512 may be identical, or alternatively may be different, depending on how they are locally energized. In one example, sequential transmitters 110 may be spaced such that their magnetic fields overlap. Alternatively, if drilling conditions permit, sequential transmitters 110 may be spaced further apart providing a cost savings for fewer transmitters.

Well 104 may be drilled from a surface location proximate wellhead 510 and, in this example, has a desired well path substantially parallel to, and at a predetermined separation distance, d, from, reference well 102. In one example, rig 111 extends drill string 122 into wellbore 104. Fluid pump 134 supplies a drilling fluid down drill string 122 which may serve as a telemetry transmission medium, as described above. Bottom hole assembly (BHA) 159 is located at the lower end of drill string 122. As used herein, bottom end and lower end are interchangeable terms and indicate a location at the end of a tubing string away from the end at the surface. In one embodiment, BHA 159 may comprise a drill bit 150, a steerable drilling assembly 160, a drilling motor 180, and a MWD tool 158. Alternatively, the mud motor may be omitted such that drill string and drill bit rotation is generated at the surface. While described here for well 104, it is to be understood that additional wells may be drilled concurrently, and or subsequently, using well 102 as a reference well. Alternatively, after well 104 is completed, it may serve as a reference well for one or more subsequent wells.

Figure 8:
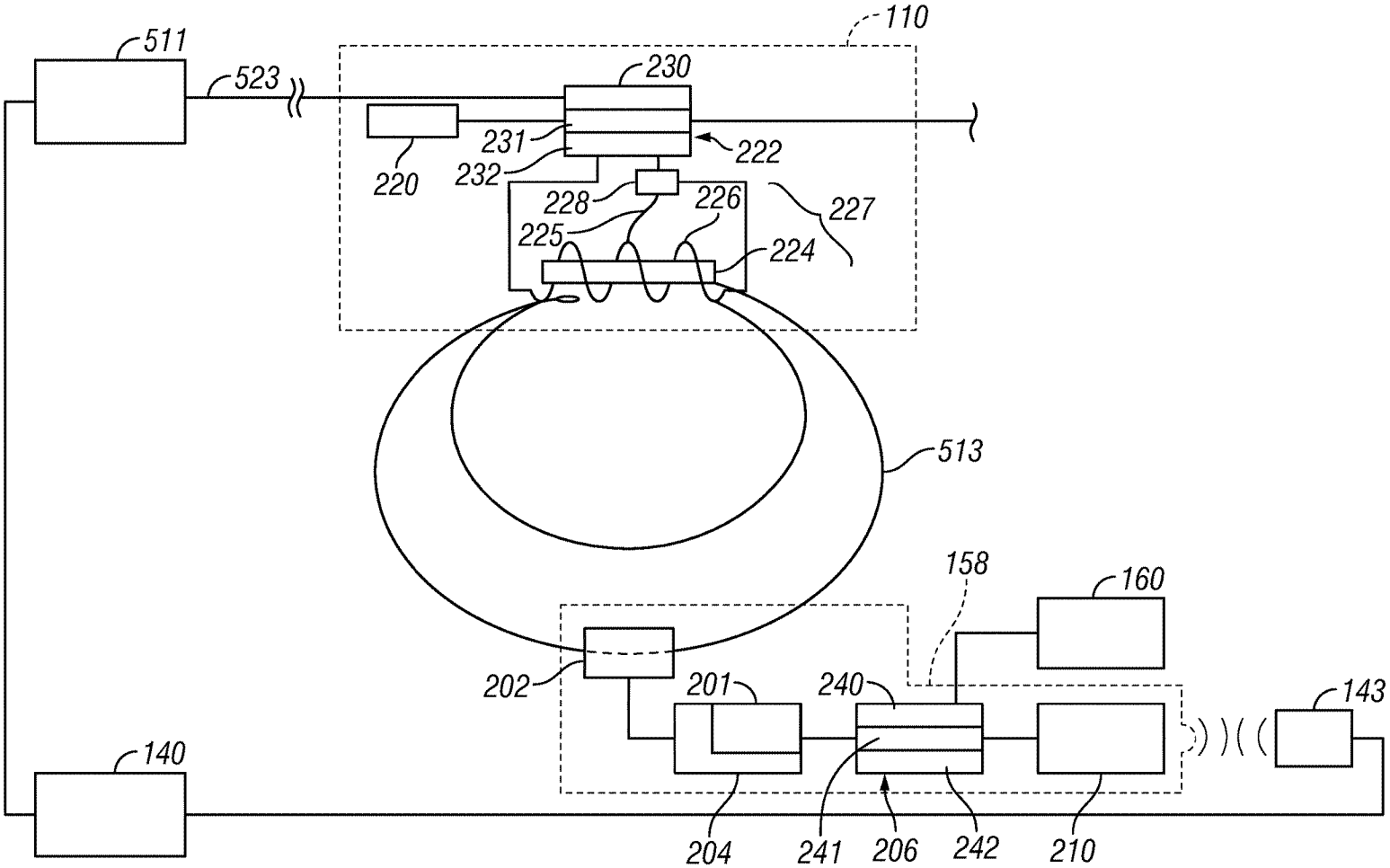
FIG. 8 shows a system functional diagram related to the system of FIG. 5.

Referring also to FIG. 8, a system functional diagram related to the system depicted in FIGS. 5-7 is shown depicting a transmitter 110 generating a magnetic field 513 that is detected by a magnetic sensor 202 in MWD tool 158. The detected magnetic signal may be processed and used by steerable drilling assembly 160 to maintain a desired separation between a reference well and a path of a second well during drilling. In one embodiment, transmitter 110 comprises a magnetic coil 227, a power storage source 220 and a controller 222. Magnetic coil 227 may comprise a core 224 and at least one coil winding 226 wrapped around core 224. In one example, winding 226 is a continuous winding. In one variation, coil 226 may have a center tap 225 such that the generated magnetic field strength may be varied between the full winding and the center tap winding. Alternatively, multiple taps may be inserted in the windings to provide multiple field strength capabilities. In yet another alternative, multiple windings having different number of turns and or different wire sizes may be used to provide varying field strength. In yet another alternative, multiple identical winding may be included for redundancy. In the embodiment shown, center tap 225 is connected to controller 222 by a switch 228. Switch 228 may be a solid state switch, comprising for example, a power metal oxide semiconductor field effect transistor (MOSFET), an insulated gate bipolar transistor (IGBT), and a thyristor. Alternatively, switch 228 may be an electromechanical switch.

In one embodiment, transmitter controller 222 comprises electronic circuits 230 for interfacing with bus 523, regulating power, and driving magnetic coil 227. Transmitter controller 222 may also comprise a processor 231 in data communication with a memory 232. Programmed instructions may be stored in memory 232 that are executed by processor 231 to control the operation of coil 227. Various coil 227 operating parameters may be controlled by the programmed instructions, including, but not limited to, activation timing, activation frequency, activation duration, and field strength. As indicated previously, field strength may be controlled by changing current through winding 226 and/or by activating switch 228 to change the winding used. Memory 232 may comprise EPROM, EEPROM, flash memory, or any other memory device suitable for downhole use.

In one embodiment, surface controller 511 comprises interface circuits 30 and a processor 31 in data communication with a memory 32. Programmed instructions stored in memory 32 provide for communications and control of the operation of the plurality of transmitters.

In one embodiment, power carried on bus 523 may be tapped by circuits 230 for driving coil 227. One skilled in the art will appreciate that bus 523 may comprise two conductors where one of the conductors is a conductive drill string. Alternatively, bus 523 may comprise a plurality of insulated electrical and/or optical conductors for providing power, a ground, and for data transmission. In another embodiment, at least some downhole energy storage is utilized for driving coil 227. In one example, power source 220 may comprise rechargeable batteries and/or one or more capacitors for storing energy from bus 523. Power from power source 220 may then be regulated by circuits 230 for powering coil 227. In another embodiment, disposable batteries may be used to power coil 227.

In one embodiment, magnetic coil 227 may be driven in a DC mode. Alternatively, magnetic coil 227 may be driven by an AC signal of at least one predetermined frequency. In one example each magnetic coil is driven at a different frequency for identifying which coil is being sensed in an adjacent drilling well. Alternatively, a transmitter identification signal may be included in a modulated signal to identify which transmitter signal is being received. In yet another example, a transmitter signal may comprise signals over multiple predetermined frequencies simultaneously.

As shown in FIG. 8, MWD system 158 comprises a magnetic sensor 202 for detecting the transmitted field 513. In one example, sensor 202 may be a multi-axis magnetometer arrangement that is part of an MWD survey package 204. Signals from magnetometer 202 may be transmitted to downhole MWD controller 206 for further processing. In one example, MWD controller 206 may comprise interface circuits 240, a processor 241, and a memory 242 in data communication with processor 241. Programmed instructions stored in memory 242 may be executed to determine the distance and direction from reference well 102 based on the detected magnetic signals using techniques known in the art. Controller 206 may also transmit signals to steerable assembly 160 to adjust the path of wellbore 104 to maintain the predetermined spacing of wellbore 104 from wellbore 102.

In one example MWD tool 158 may transmit data related to the detected magnetic field and/or the spacing and direction to the in-range transmitter 110 to surface sensor 143 via a telemetry transmission scheme. The transmission scheme may comprise mud-pulse telemetry, acoustic telemetry, electromagnetic wave telemetry, wired pipe, combinations thereof, and any other suitable form of telemetry.

In one embodiment, MWD surface controllers 140 may be in data communication with transmitter surface controller 511. The data communication may be over wire, fiber optic link or a wireless technique. Signals related to the separation distances from reference well 102 and BHA 159 may transmitted to surface controller 511. Knowing the depths of BHA 159 the particular transmitters detected can be identified. In an operating scheme wherein the transmitters are only turned on when a drilling system is in proximity, this may allow controller 511 to activate the next transmitter for guiding the BHAs. In another embodiment, where each transmitter transmits at a different frequency, the MWD tool may transmit data related to the detected frequency allowing the surface controller to know which transmitter is proximate the BHA, and to know the next transmitter to activate.

In one embodiment, multiple wells may be simultaneously drilled in proximity to reference well 102. Controller 511 may receive data related to the location of each drilling system and activate the appropriate transmitter as required. In another example, each transmitter may be activated continuously. In yet another embodiment, each transmitter, or all transmitters, may be activated at predetermined intervals. The MWD systems in each well may be programmed to sense the magnetic signals either continuously, or at the predetermined activation intervals.

Figure 9:
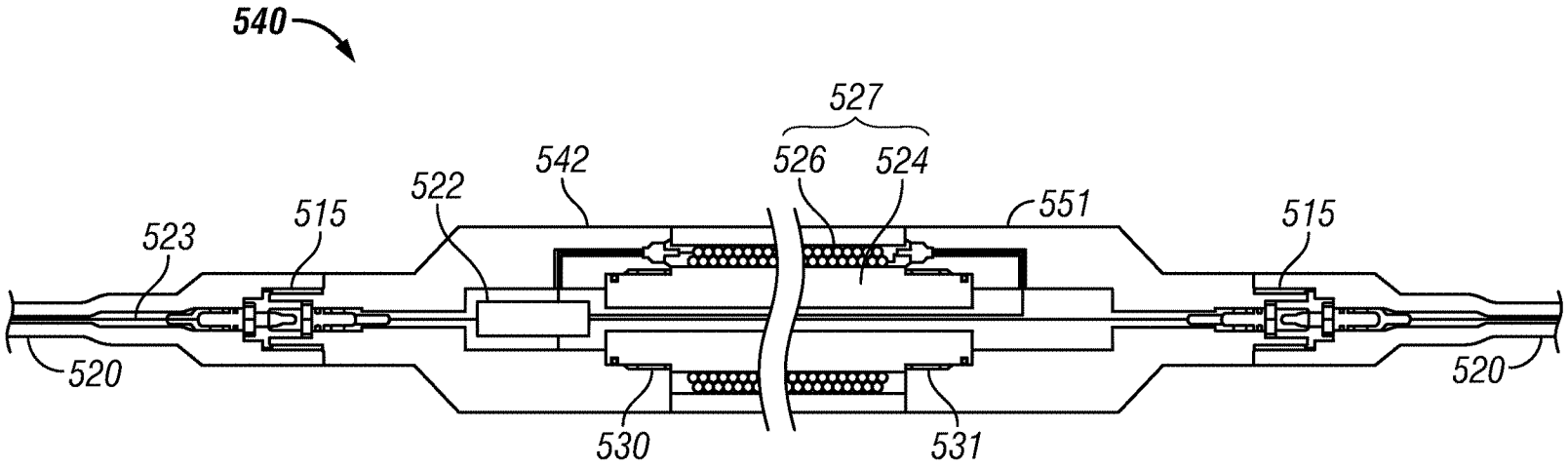
FIG. 9 shows an example transmitter.

FIG. 9 shows one example embodiment of a transmitter 540 for transmitting a magnetic signal. Multiple transmitters may be deployed in a reference well on tubing sections 520. Electrical conductor 523 may serve as a power and/or communications bus for the transmitters in the system. In the example shown, an upper tubing section 520 connects to upper transmitter housing 542. As used herein, the term upper section and lower section are relative to the closeness to the surface well opening, along the wellbore, with the upper section being closer to the opening, and the lower section farther away. Upper transmitter housing 542 houses transmitter controller 522 having the capabilities as describe previously. In this example core 524 of coil 527 is threaded into upper transmitter housing 542 using threaded connection 530. In one example, core 524 may be a load sharing member. Winding 526 may comprise a single winding or multiple windings as described previously. Winding 526 may also comprise multiple taps for changing the effective strength of the field generated by coil 527. The lower end of core 524 is threaded into lower transmitter housing 551 at threaded connection 531 and which is then connected to a lower tubing section 520. Electrical connections are made at each end through connectors 515.

Figure 10:
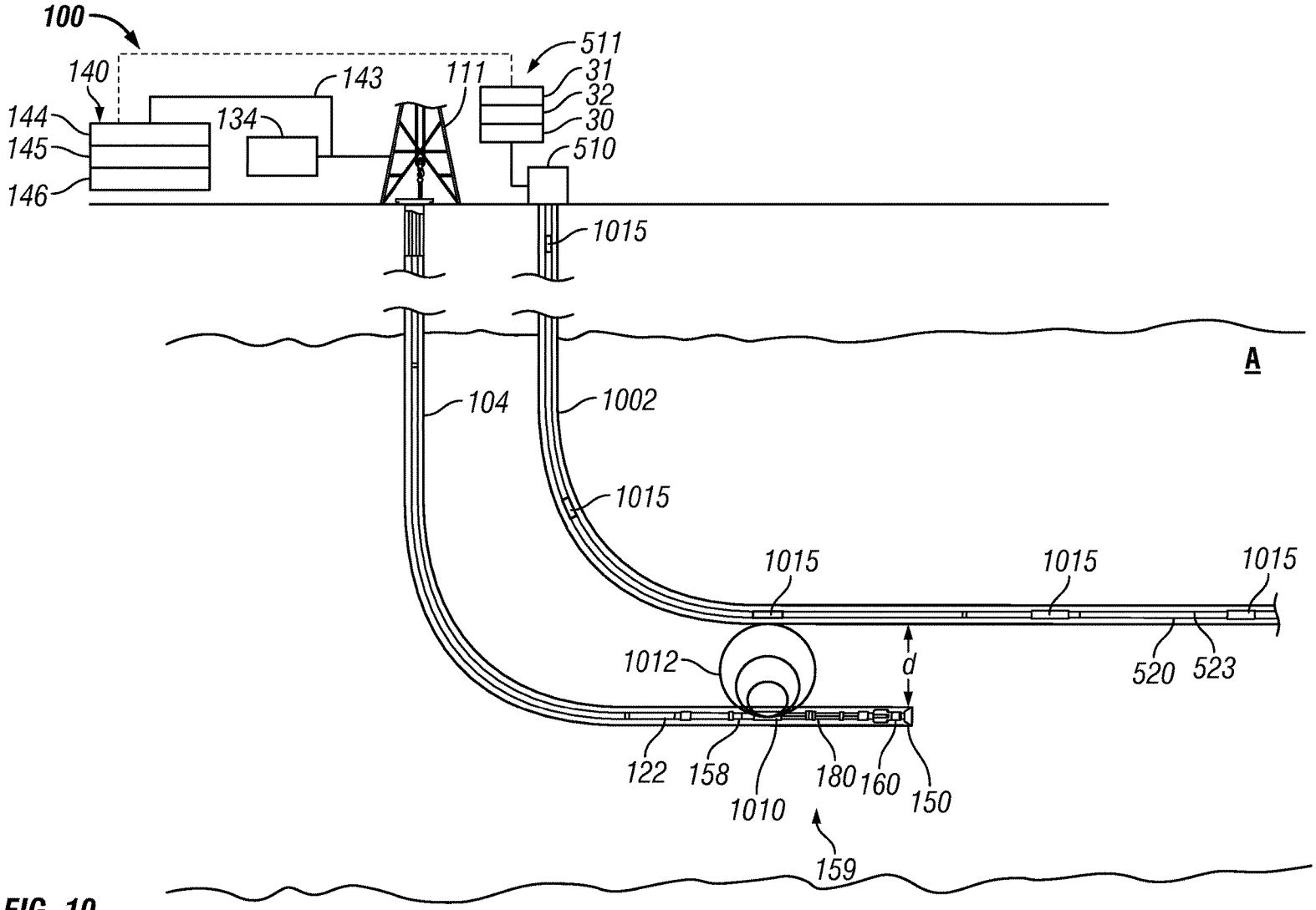
FIG. 10 shows another example of a drilling system for drilling at least one well with relation to a reference well.

While described above with reference to deploying the transmitters in the reference well and the receivers in the drilling well, it will be clear to one skilled in the art that receivers 1015 may be located in reference well 1002 and a transmitter 1010 may located in the BHA, see FIG. 10. The receivers 1015 and the transmitter 1010 may be any of the example receivers and transmitters described herein.

Figure 11:
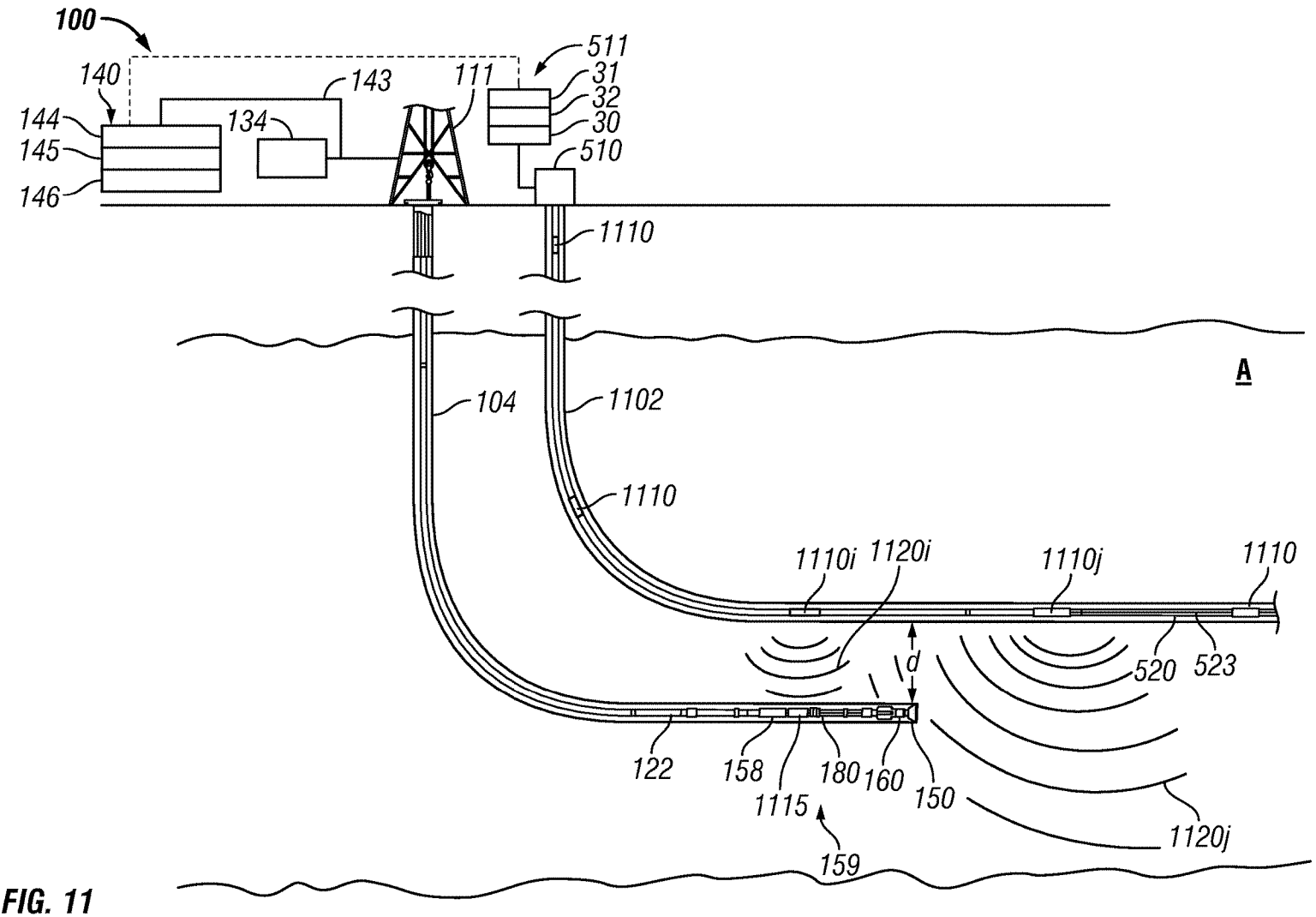
FIG. 11 shows yet another example of a drilling system for drilling at least one well with relation to a reference well.
Figure 12:
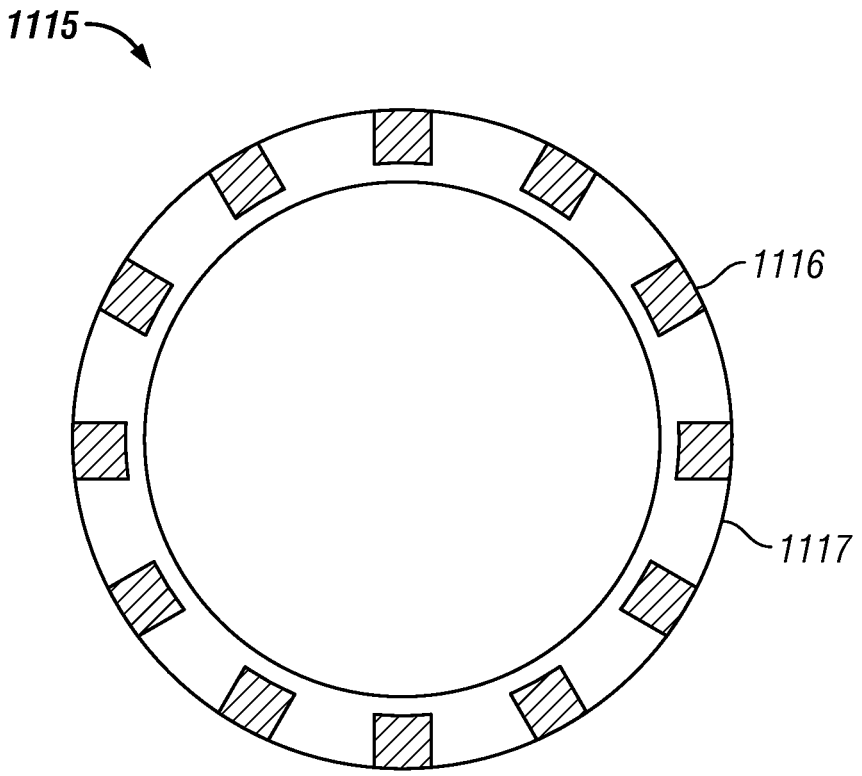
FIG. 12 shows an example of a circumferentially segmented receiver.

In addition, other types of transmitters and receivers may be used. In one example, see FIG. 11, a plurality of acoustic transmitters 1110 may be located at spaced apart locations in reference well 1102. Transmitters 1110 may transmit an acoustic signal that is detected by an acoustic receiver 1115 in BHA 159. In the example shown, transmitters **1110*i* and 1110*j* transmit acoustic signals 1120*i* and 1120*j* that are both detected at receiver 1115. Knowing the distance between transmitters 1110*i* and 1110*j* and the sound speed in the formation, triangulation techniques known in the art may be used to determine the distance d between the transmitter and the receiver. If the receiver is rotating in the borehole, then only a button type receiver is required to determine the direction to the transmitters. The receiver angular location may be tied to the directional package orientation using techniques known in the art. By detecting maxima and minima of the acoustic signal as the receiver rotates in the wellbore, the relative direction may be determined to the transmitter. In one embodiment, FIG. 12, where the receiver does not rotate during drilling, receiver 1115 comprises a circumferentially segmented receiver having a plurality of receiver elements 1116 located around the circumference of a housing 1117 of receiver 1115. In one example, receiver elements may be piezoelectric elements known in the art. For drilling where the receiver section does not rotate in the wellbore, the multiple segments may be used to determine the direction to the transmitter 1110**.

Figure 13:
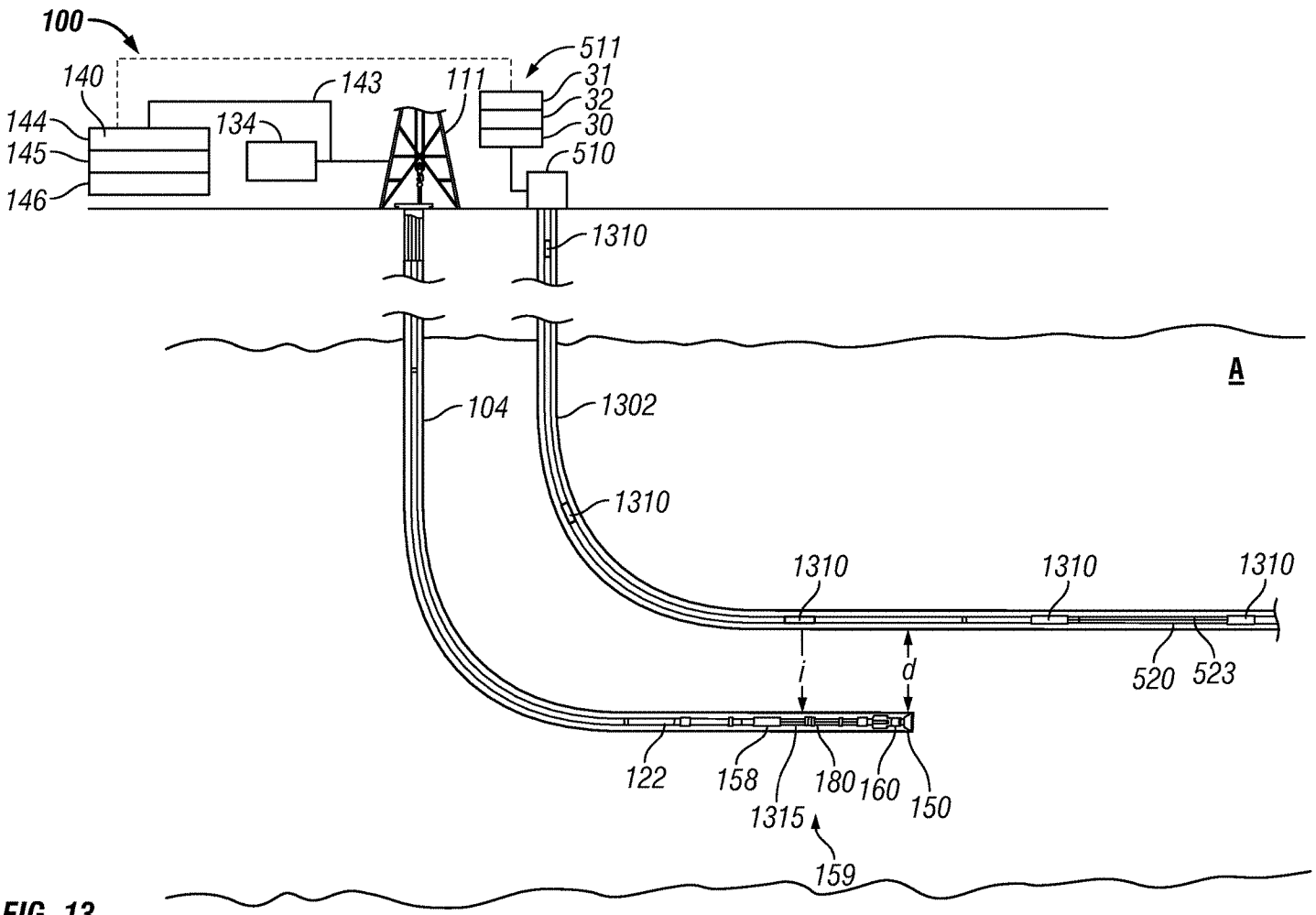
FIG. 13 shows still another example of a drilling system for drilling at least one well with relation to a reference well.

In another example, see FIG. 13, transmitter 1310 injects a current into the formation that is detected by a current detector in receiver 1315. Using known formation resistivity and/or in situ calibration, the measured current may be used to determine the distance to the transmitter. By rotating the receiver in the hole and/or by mounting multiple current probes around the circumference of receiver 1315, the direction to transmitter 1310 can be determined similar to that discussed above.

Figure 14:
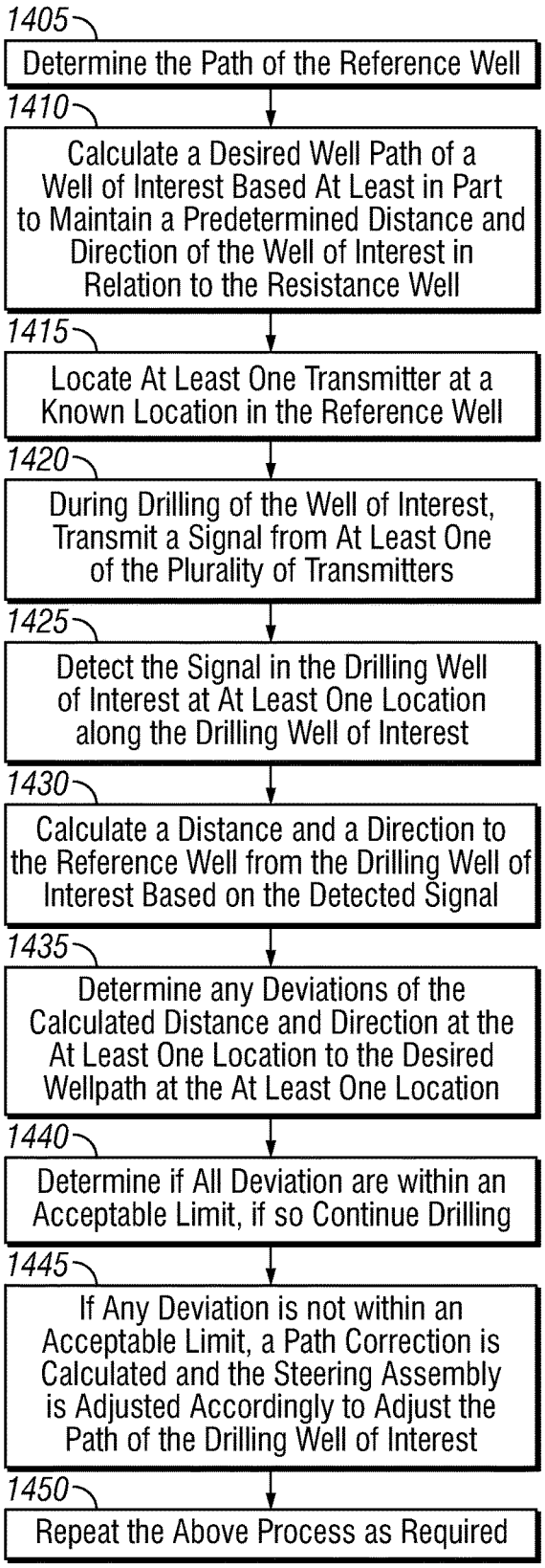
FIG. 14 shows an example of flow chart of an operational method of drilling at least one well with relation to a reference well.

In one example operational method, see FIG. 14, the systems and tools described above may be used to drill at least one well of interest relative to a reference well. One example method comprises, determining the path of the reference well in logic box 1405. This may be done using traditional surveying techniques known in the art. Alternatively, the reference well path may be determined by a relative measurement to another well with a known path.

In logic box 1410, a desired path of a well of interest to be drilled may be planned. The well path of interest is based, at least in part, to maintain a predetermined distance and direction of the well of interest in relation to the reference well.

In logic box, 1415, at least one transmitter is located at a known location in the reference well. The transmitter location may be predetermined location. Alternatively, the transmitter location may be determined after the transmitter is located in the reference well. In one embodiment, the transmitter may be traversed along the reference well.

During drilling of the well of interest, a signal is transmitted from the at least one transmitter, see logic box 1420. As used herein, the phrase, "during drilling of the well", is intended to mean during actual drilling and during normal stoppages and off-bottom time during the overall drilling process.

The transmitted signal is detected at at least one location along the drilling well of interest in logic box 1425.

A distance and direction from the drilling well of interest to the reference well is calculated based on the detected signal in logic box 1430.

Any deviations of calculated distance and direction from the well of interest to the planned predetermined distance and predetermined direction at the measurement location are determined in logic box 1435.

A deviation is compared to an acceptable limit and if all deviations are within acceptable limits, drilling continues along the present path in logic box 1440.

If a deviation is not within an acceptable limit, then a path correction is calculated and the steering assembly is adjusted accordingly to adjust the path of the drilling well of interest, see logic box 1445. In one example, the path correction may be intended to bring the drilling path back onto the original desired path. In another example, a new path with new distances and directions between the well of interest and the reference well may be calculated to achieve the original drilling target requirements.

The above process may be repeated until the well of interest has completed drilling, see logic box 1450.

In one embodiment, downhole controller 134 receives the measurements of position and direction of the well of interest and autonomously performs the calculation and well planning actions of the above method and transmits instructions to steerable drilling assembly 160 to adjust the well of interest path to return the wellbore to the original desired distance and direction from the reference well.

Figure 15:
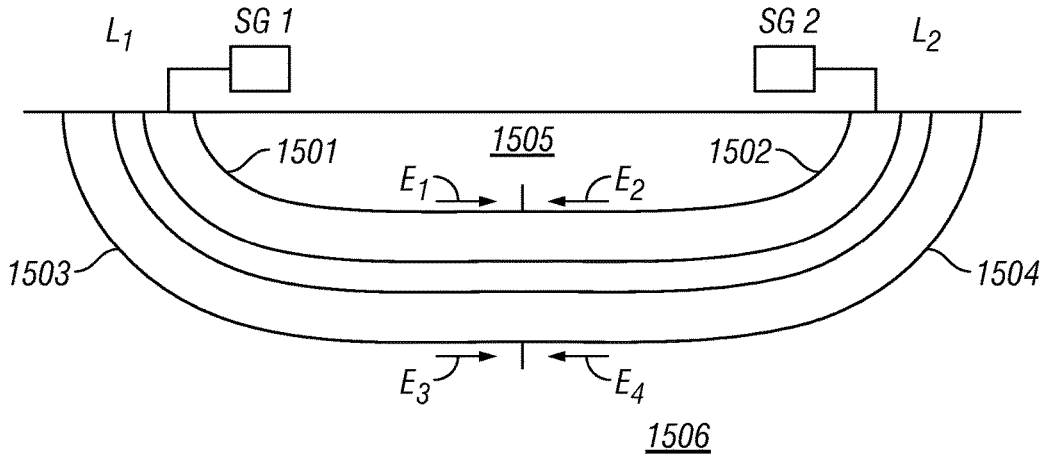
FIG. 15 shows an example of an operational method of drilling multiple wells from different starting locations with relation to a reference well.

In another operational example, the systems described above may be used in a method to drill multiple wells as shown in FIG. 15. In common SAGD applications, a first well similar to the reference well described above may be drilled that ends at some measured depth from the surface drilling location. A second well may be drilled parallel to the first well using the relative measurement techniques described previously. Steam may be forced through the first well. The steam heats up the surrounding formation and the hydrocarbons therein. The heated hydrocarbons flow in the formation more easily than in the unheated condition. The second well, typically drilled below the first well is used as a gravity drainage collector for the hydrocarbons and steam condensate which are pumped back to the surface.

In some applications, it may be desirable to have access to both ends of the first and second wells to enhance oil recovery. Alternatively, this method may allow a producing well length that is substantially longer than if a single well is drilled well. In one example, well 1501 is drilled from surface location L1 to an end point E1. A second well 1502 may be drilled from surface location L2 to an end point E2 which intersects well 1502 at E1. The combination of wells 1501 and 1502 result in injection well 1505. In one example, suitable well guidance techniques described above may be used to drill wells 1503 and 1504 from surface locations L1 and L2 respectively. Alternatively, a single producing well 1506 may be drilled from surface location L1 or L2 that effectively covers the same path as wells 1503 and 1504 and uses injection well 1505 as a reference guide as described above. In one example, steam generators SG1 and SG2 may inject steam from either, or both, ends of injection well 1505. The dual injection may be more effective at delivering steam to the injection wellbore for increased production. This is due to the loss of latent heat along the borehole length. By injecting or even circulating pressurized steam through the upper well using the two end points more latent heat can be disposed into the upper wellbore than could be possible with a dead ended well. As used herein, the term upper well is a well closer to the earth's surface than a lower well. This can help increase the usable well bore length by not having to push all the steam into the formation as would be required by a dead ended well thereby permitting an escape path for the lower temperature steam to exit. Further the flow direction of the steam can be reversed from time to time to increase the formation temperature on the other end of the well and vise versa to boost production.

Figure 16A:
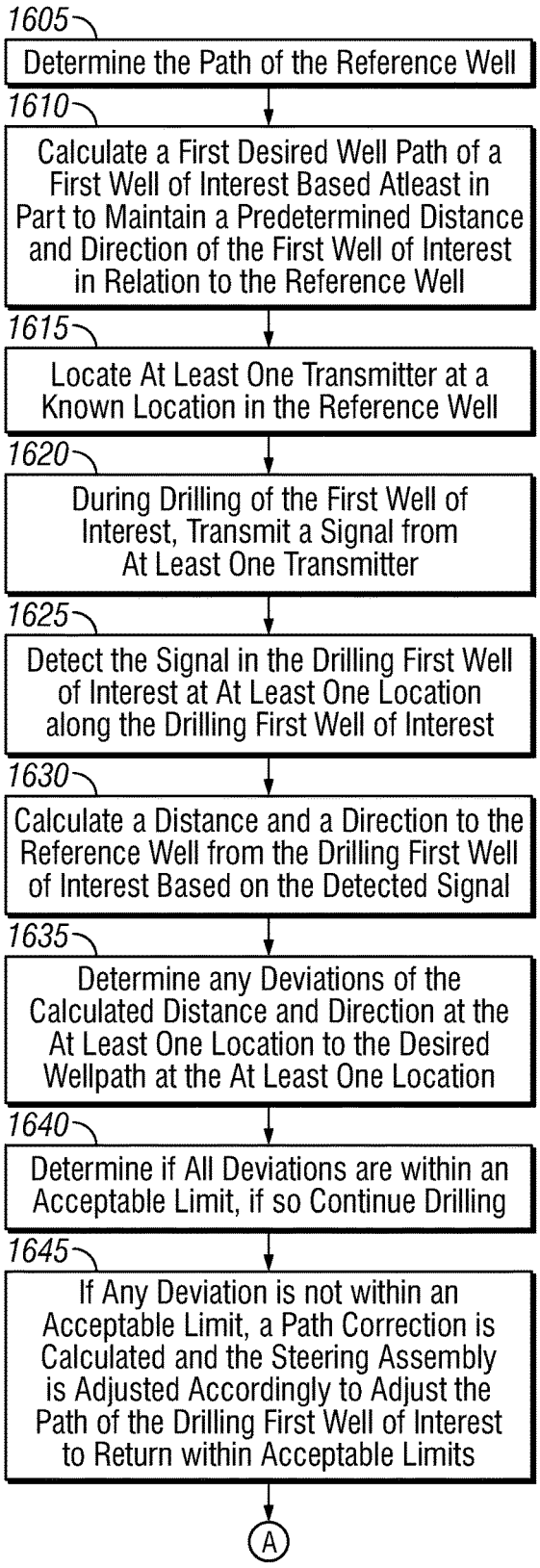
FIGS. 16A-C show an example of an operational method of drilling multiple wells from different surface locations referenced to a reference well While the invention is susceptible to various modifications and alternative forms, specific embodiments thereof are shown by way of example in the drawings and will herein be described in detail. It should be understood, however, that the drawings and detailed description herein are not intended to limit the invention to the particular form disclosed, but on the contrary, the intention is to cover all modifications, equivalents and alternatives falling within the scope of the present invention as defined by the appended claims.
Figure 16B:
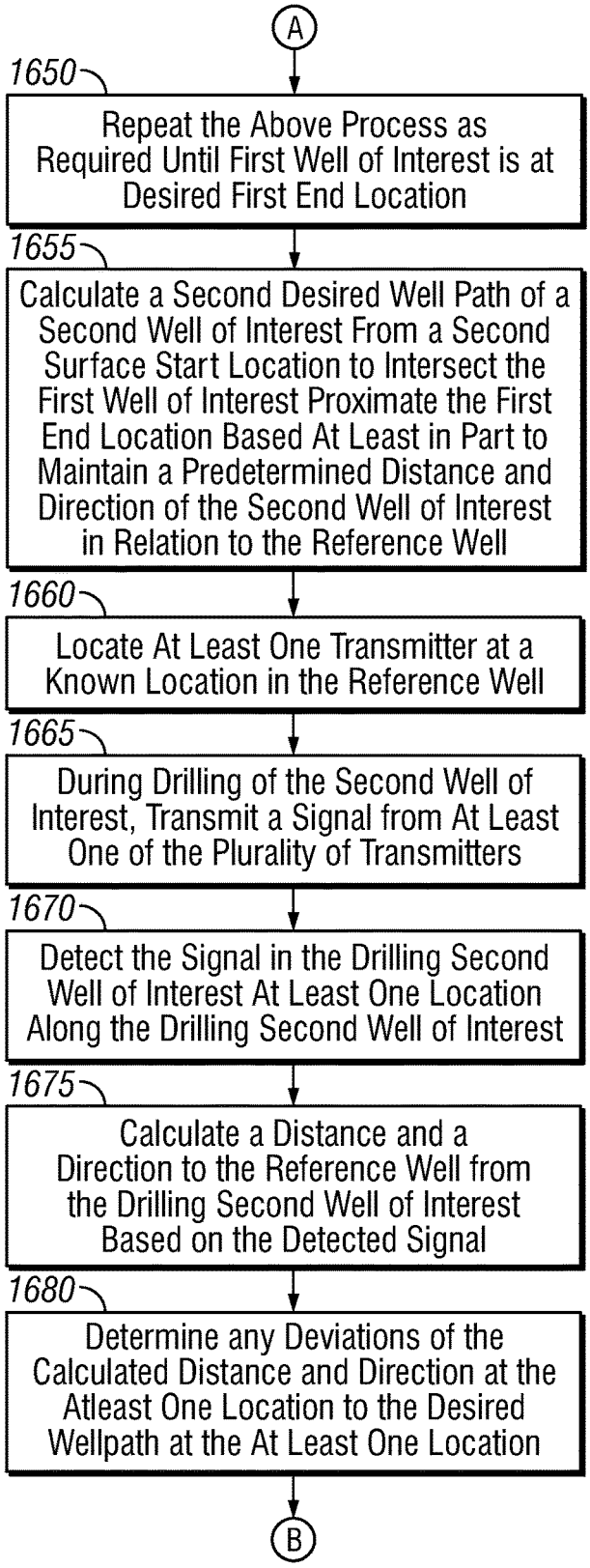
Figure 16C:
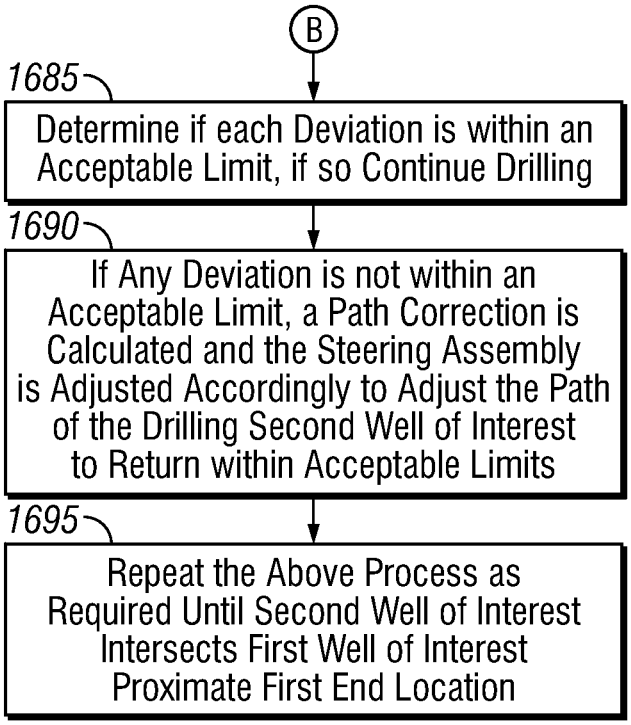

FIG. 16 shows a method of drilling multiple wells from different surface locations referenced to a reference well. Initially, the path of the reference well is determined in logic box 1605. This may be done using traditional surveying techniques known in the art. Alternatively, the reference well path may be determined by a relative measurement to another well with a known path. In one example, the reference well may be a well having a start point and end point at the surface.

In logic box 1610, a first desired well path of a first well of interest from a first surface location is calculated, based at least in part to maintain a predetermined distance and direction of the first well of interest in relation to the reference well.

At least one transmitter is located at a known location in the reference well in logic box 1615.

A signal is transmitted from the at least one transmitter during drilling of the first well of interest in logic box 1620. As used herein, the phrase, "during drilling of the well", is intended to mean during actual drilling and during normal stoppages and off-bottom time during the overall drilling process.

The transmitted signal is detected at at least one location along the drilling well of interest in logic box 1625.

A distance and direction from the reference well to the first drilling well of interest is calculated based on the detected signal in logic box 1630.

Any deviations of calculated distance and direction from the first well of interest to the desired well path at the at least one location are determined in logic box 1635.

Any deviation at the at least one location is compared to an acceptable limit and if all deviations are within an acceptable limits, drilling continues along the present path in logic box 1640.

If any deviation is not within an acceptable limit, then a path correction is calculated and the steering assembly is adjusted accordingly to adjust the path of the drilling first well of interest, see logic box 1645. In one example, the path correction may be intended to bring the drilling path back onto the original desired path. In another example, a new path with new distances and directions between the well of interest and the reference well may be calculated to achieve the original drilling target requirements.

The above process may be repeated until the first well of interest has reached a desired first end location, see logic box 1650.

In logic box 1655, a second desired well path of a second well of interest from a second surface start location to intersect the first well of interest proximate the first end location is calculated, based at least in part to maintain a predetermined distance and direction of the second well of interest in relation to the reference well.

At least one transmitter is located at a known location in the reference well in logic box 1660.

A signal is transmitted from the at least one transmitter during drilling of the second well of interest in logic box 1665.

The transmitted signal is detected at at least one location along the drilling second well of interest in logic box 1670.

A distance and direction from the reference well to the drilling second well of interest is calculated based on the detected signal in logic box 1675.

Any deviations of calculated distance and direction from the drilling second well of interest to the desired well path at the at least one location are determined in logic box 1680.

Any deviation at the at least one location is compared to an acceptable limit and if all deviations are within an acceptable limits, drilling continues along the present path in logic box 1685.

If any deviation is not within an acceptable limit, then a path correction is calculated and the steering assembly is adjusted accordingly to adjust the path of the drilling second well of interest, see logic box 1690. In one example, the path correction may be intended to bring the drilling path back onto the original desired path. In another example, a new path with new distances and directions between the well of interest and the reference well may be calculated to achieve the original drilling target requirements.

The above process may be repeated until the second well of interest intersects the first well of interest proximate the first end location, see logic box 1695.

Numerous variations and modifications will become apparent to those skilled in the art. It is intended that the following claims be interpreted to embrace all such variations and modifications.

The invention claimed is:

1. A method for drilling at least one well of interest comprising:

calculating a desired path for the at least one well of interest relative to at least one reference well;

measuring a position of the at least one well of interest relative to the at least one reference well at at least one location along a wellbore of the at least one well of interest by transmitting at least one electrical current signal from at least one transmitter disposed in the at least one reference well into the formation and detecting the at least one electrical current signal with at least one current detector in a receiver in the at least one well of interest; wherein the measuring the position comprises measuring the distance between the receiver and the transmitter using the electrical current signal detected by the at least one current detector and the formation resistivity values to calculate the distance; wherein measuring the position further comprises measuring the direction of the transmitter relative to the receiver using a method selected from the group consisting of rotating the receiver in the at least one well of interest, mounting multiple current probes around the circumference of the receiver, and a combination thereof; wherein the at least one transmitter comprises a plurality of transmitters axially spaced apart along at least a portion of the length of the wellbore, each transmitter of the plurality of transmitters transmitting a different frequency from the frequency of each other transmitter;

calculating an actual path of the at least one well of interest, based at least in part on the measured position of the at least one well of interest relative to the at least one reference well, in a downhole controller positioned downhole and operatively coupled to the at least one receiver;

comparing the actual path of the at least one well of interest to the desired path of the at least one well of interest in the downhole controller; and wherein the downhole controller autonomously performs the calculation and comparison and autonomously transmits instructions to adjust a drilling system to modify the actual path of the at least one well of interest based at least in part on a deviation between the actual path of the at least one well of interest and the desired path of the at least one well of interest.

2. The method of claim 1 wherein adjusting a drilling system to modify the actual path of the at least one well of interest based at least in part on the difference between the actual path of the at least one well of interest and the desired path of the at least one well of interest comprises adjusting a steerable drilling assembly in a drillstring disposed in the at least one well of interest.

3. The method of claim 1 wherein adjusting a drilling system to modify the actual path of the at least one well of interest based at least in part on the difference between the actual path of the at least one well of interest and the desired path of the at least one well of interest comprises at least one of: calculating an adjusted path of the at least one well of interest to return to the desired path of the at least one well of interest, and calculating a modified desired path of the at least one well of interest.

4. The method of claim 1 wherein the desired path of at least a portion of the at least one well of interest comprises at least one of: a substantially constant distance from the at least one reference well; and a predetermined varying distance from the at least one reference well.

5. A method for drilling two intersecting wells of interest referenced to a reference well comprising:

autonomously calculating in a first downhole controller positioned downhole, a desired path for a first well of interest from a first surface start location to a first end location based at least in part to maintain a predetermined distance and direction of the first well of interest in relation to the reference well;

the first downhole controller autonomously instructs a first steerable drilling assembly to drill the first well of interest along the desired path for the first well of interest from the first surface start location to the first end location based at least in part on detecting either a distance or a direction or both between the first well of interest and the reference well; wherein detecting a distance or a direction or both between the first well of interest and the reference well comprises transmitting at least one electric current signal from one of the reference well and the first well of interest in the formation and detecting the transmitted electric current signal at the other of the reference well and the first well of interest; wherein the detecting the distance between the first well of interest and the reference well comprises using the detected transmitted electric current signal and the formation resistivity values; wherein measuring the direction between the first well of interest and the reference well comprises using a method selected from the group consisting of rotating the receiver in the at least one well of interest, mounting multiple current probes around the circumference of the receiver, and a combination thereof;

autonomously calculating in a second downhole controller positioned downhole, a desired path for a second well of interest from a second surface start location to intersect the first well of interest at the first end location based at least in part to maintain a predetermined distance and direction of the second well of interest in relation to the reference well; and the second downhole controller autonomously instructs a second steerable drilling assembly to drill the second well of interest along the desired path for the second well of interest from the second surface start location to the first end location based at least in part on detecting a distance and a direction between the second well of interest and the reference well.

6. The method of claim 5 wherein detecting a distance and direction between the second well of interest and the reference well comprises transmitting at least one signal from one of the reference well and the second well of interest and detecting the transmitted signal at the other of the reference well and the second well of interest.

* * * * *